US011480914B2

(12) United States Patent
Suzuki et al.

(10) Patent No.: US 11,480,914 B2
(45) Date of Patent: Oct. 25, 2022

(54) IMAGE FORMING APPARATUS INCLUDING A REGULATING PORTION USED IN MOUNTING A CARTRIDGE

(71) Applicant: CANON KABUSHIKI KAISHA, Tokyo (JP)

(72) Inventors: Tetsuji Suzuki, Kanagawa (JP); Daisuke Yamamoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/341,019

(22) Filed: Jun. 7, 2021

(65) Prior Publication Data

US 2021/0389717 A1 Dec. 16, 2021

(30) Foreign Application Priority Data

Jun. 12, 2020 (JP) ..... JP2020-102029

(51) Int. Cl.
*G03G 21/16* (2006.01)
*G03G 21/18* (2006.01)

(52) U.S. Cl.
CPC ..... *G03G 21/1647* (2013.01); *G03G 21/1676* (2013.01); *G03G 21/1842* (2013.01); *G03G 21/1853* (2013.01); *G03G 21/1857* (2013.01)

(58) Field of Classification Search
CPC ..... G03G 21/1647; G03G 21/1676; G03G 21/1842; G03G 21/1853; G03G 21/1857; G03G 21/186; G03G 21/1814; G03G 2221/183
See application file for complete search history.

(56) References Cited

U.S. PATENT DOCUMENTS

2004/0105699 A1 6/2004 Kubota
2017/0357210 A1* 12/2017 Inaba ..... G03G 21/1647
(Continued)

FOREIGN PATENT DOCUMENTS

EP 0 520 802 A2 12/1992
JP H086471 A 1/1996
(Continued)

*Primary Examiner* — Sophia S Chen
(74) *Attorney, Agent, or Firm* — Canon U.S.A., Inc. I.P. Division

(57) ABSTRACT

An image forming apparatus includes a cartridge including a portion-to-be-positioned, and an apparatus main body on which the cartridge is mounted in a mounting direction. The apparatus main body includes a positioning portion and a regulating portion. The positioning portion positions the cartridge by engaging with the portion-to-be-positioned. The regulating portion is provided on an upstream side of the positioning portion in the mounting direction. The cartridge includes a portion-to-be-regulated provided on an upstream side of the portion-to-be-positioned in the mounting direction. The portion-to-be-positioned engages with the regulating portion before engaging with the positioning portion, to regulate movement of the cartridge in the direction orthogonal to the mounting direction. The portion-to-be-regulated engages with the regulating portion before the portion-to-be-positioned engages with the positioning portion, to regulate movement of the cartridge in the direction orthogonal to the mounting direction.

15 Claims, 14 Drawing Sheets

(56) References Cited

U.S. PATENT DOCUMENTS

| | | | | |
|---|---|---|---|---|
| 2018/0024494 | A1* | 1/2018 | Shibuya | G03G 21/1676 399/119 |
| 2019/0129357 | A1* | 5/2019 | Tanaka | G03G 21/1647 |
| 2020/0272095 | A1* | 8/2020 | Kamoshida | G03G 21/1647 |

FOREIGN PATENT DOCUMENTS

| | | | |
|---|---|---|---|
| JP | H09101734 | A | 4/1997 |
| JP | 2016141513 | A | 8/2016 |
| JP | 2017223952 | A | 12/2017 |

* cited by examiner

IMAGE FORMING APPARATUS INCLUDING A REGULATING PORTION USED IN MOUNTING A CARTRIDGE

BACKGROUND OF THE INVENTION

Field of the Invention

The present invention relates to an electrophotographic image forming apparatus. Examples of the image forming apparatus include an electrophotographic copier, electrophotographic printers (such as a light-emitting diode (LED) printer and a laser beam printer), a facsimile apparatus, and a word processor.

Description of the Related Art

In an electrophotographic image forming apparatus, a cartridge in which a photosensitive drum, a charging unit, a developing unit, a cleaning unit, and other units are collected inside a frame is practically used as a process cartridge mountable/demountable on/from an apparatus main body of the image forming apparatus.

Japanese Patent Application Laid-Open No. 2017-223952 discusses a configuration in which a concave portion (portion-to-be-positioned) of a process cartridge engages with a convex portion (positioning portion) of an apparatus main body to fix a position of the cartridge relative to the apparatus main body in a direction orthogonal to a mounting direction when the process cartridge is mounted on the apparatus main body.

SUMMARY OF THE INVENTION

According to an aspect of the present invention, an image forming apparatus includes a cartridge including a portion-to-be-positioned, and an apparatus main body on which the cartridge is mounted in a mounting direction. The apparatus main body includes a positioning portion and a regulating portion. The positioning portion is configured to position the cartridge in a direction orthogonal to the mounting direction by engaging with the portion-to-be-positioned of the cartridge when mounting of the cartridge on the apparatus main body is completed. The regulating portion is provided on an upstream side of the positioning portion in the mounting direction. The cartridge includes a portion-to-be-regulated provided on an upstream side of the portion-to-be-positioned in the mounting direction. The portion-to-be-positioned of the cartridge engages with the regulating portion of the apparatus main body before engaging with the positioning portion of the apparatus main body, to regulate movement of the cartridge in the direction orthogonal to the mounting direction. The portion-to-be-regulated of the cartridge engages with the regulating portion before the portion-to-be-positioned engages with the positioning portion of the apparatus main body, to regulate movement of the cartridge in the direction orthogonal to the mounting direction.

Further features of the present invention will become apparent from the following description of exemplary embodiments with reference to the attached drawings.

DESCRIPTION OF THE EMBODIMENTS

Figure 1:
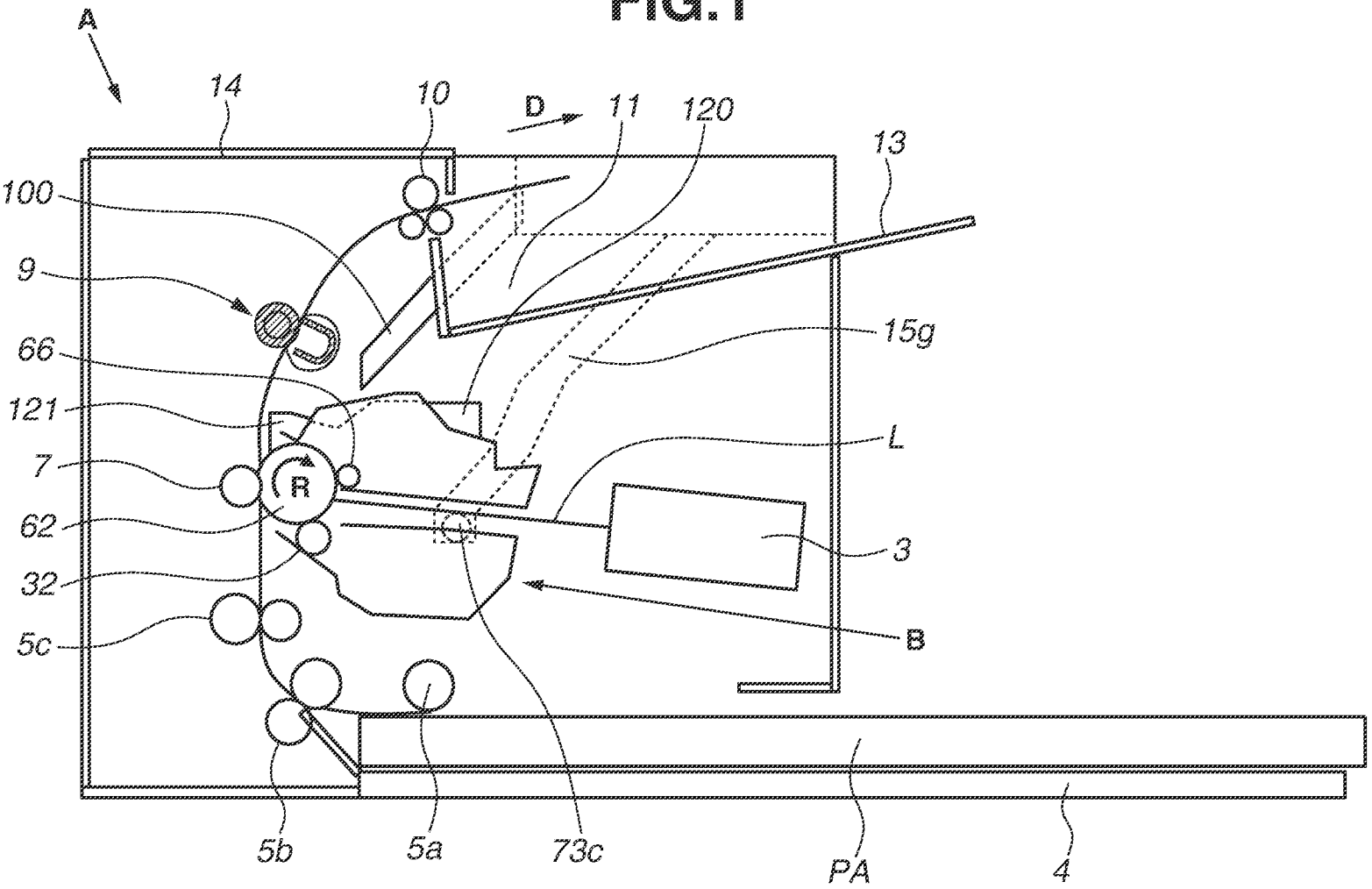
FIG. 1 is a cross-sectional view of an image forming apparatus according to a first exemplary embodiment.

An entire configuration of an electrophotographic image forming apparatus and an image forming process according to a first exemplary embodiment are described. FIG. 1 is a cross-sectional view of the electrophotographic image forming apparatus according to the first exemplary embodiment. The image forming apparatus includes an apparatus main body A and a process cartridge B (hereinafter, referred to as cartridge B). The apparatus main body A is a portion of the image forming apparatus excluding the cartridge B. A rotation axis direction of an electrophotographic photosensitive drum is defined as a longitudinal direction. In the longitudinal direction, a side on which the electrophotographic photosensitive drum receives driving force from the apparatus main body of the image forming apparatus is defined as a drive side, and a side opposite thereto is defined as a non-drive side.

<Image Forming Apparatus>

The image forming apparatus illustrated in FIG. 1 is a laser beam printer using an electrophotographic technique, and the cartridge B is mountable/demountable on/from the apparatus main body A.

The cartridge B includes a photosensitive drum 62 as an image carrier, a charging roller 66, and a developing roller 32. The apparatus main body A includes a sheet tray 4 storing a sheet material PA, a pickup roller 5*a*, a feeding roller pair 5*b*, a conveyance roller pair 5*c*, a transfer roller 7, a fixing device 9, a discharge roller pair 10, and a discharge tray 11 that are sequentially disposed along a conveyance direction D of the sheet material PA. The apparatus main body A further includes an opening/closing door 13, and a laser scanner as an exposure device. The opening/closing door 13 includes the discharge tray 11 as a top surface, and is opened/closed for mounting/demounting of the cartridge B.

<Image Forming Process>

An outline of the image forming process is described. The photosensitive drum 62 (hereinafter, referred to as drum 62) is rotationally driven in an arrow R direction at a predetermined circumferential velocity (process speed) in response to a print start signal. The charging roller (charging member 66) to which a voltage is applied comes into contact with and charges an outer peripheral surface of the drum 62.

The laser scanner 3 emits a laser beam L corresponding to image information. The outer peripheral surface of the drum 62 is scanned and exposed with the laser beam L. As a result, an electrostatic latent image corresponding to the image information is formed on the outer peripheral surface of the drum 62.

The developing roller 32 carrying toner inside the cartridge B supplies the toner to the drum 62 based on the electrostatic latent image, and develops the latent image. As a result, the latent image is visualized as a toner image.

Further, as illustrated in FIG. 1, the sheet material PA is sent out from the sheet tray 4 by the pickup roller 5*a*, the feeding roller pair 5*b*, and the conveyance roller pair 5*c* in synchronization with output timing of the laser beam L. Further, the sheet material PA is conveyed to a transfer portion formed by contact of the drum 62 and the transfer roller 7. The toner image is transferred from the drum 62 to the sheet material PA by the transfer portion.

The sheet material PA to which the toner image has been transferred is separated from the drum 62 and conveyed to the fixing device 9. Thereafter, the sheet material PA is subjected to pressing and heat fusing processing at a nip portion constituting the fixing device 9, and the toner image is fixed onto the sheet material PA. The sheet material PA subjected to the fixing processing of the toner image is conveyed to the discharge roller pair 10 and is discharged to the discharge tray 11.

<Mounting of Cartridge on Apparatus Main Body>

Figure 2A:
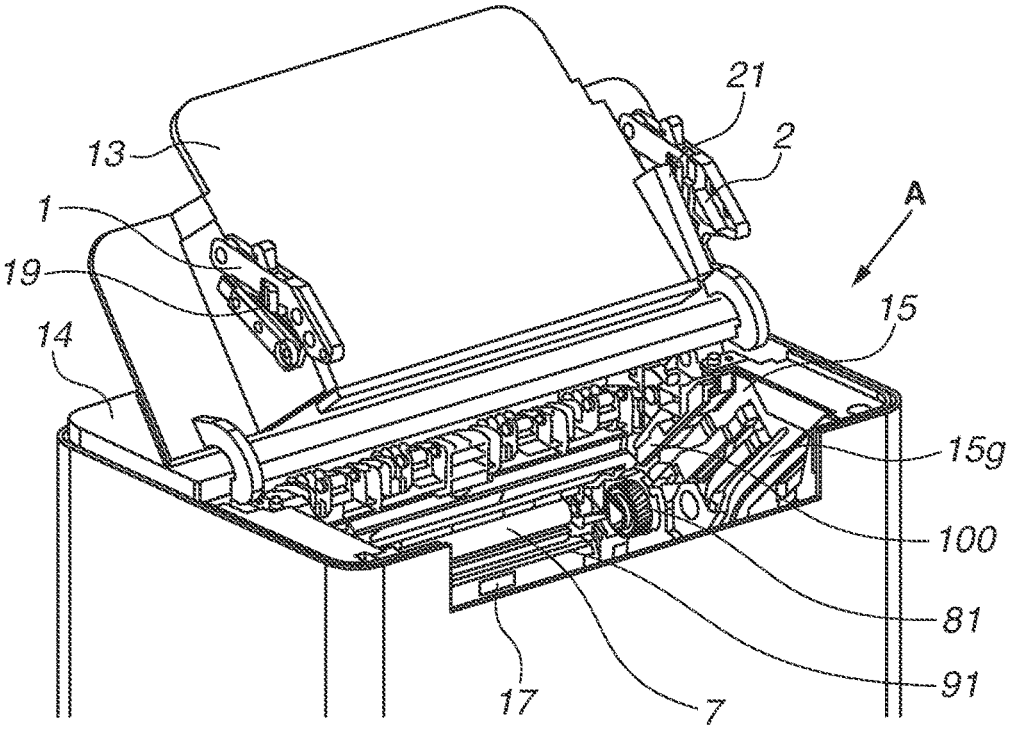
FIG. 2A is a perspective view of an apparatus main body in a state where an opening/closing door is opened.
Figure 2B:
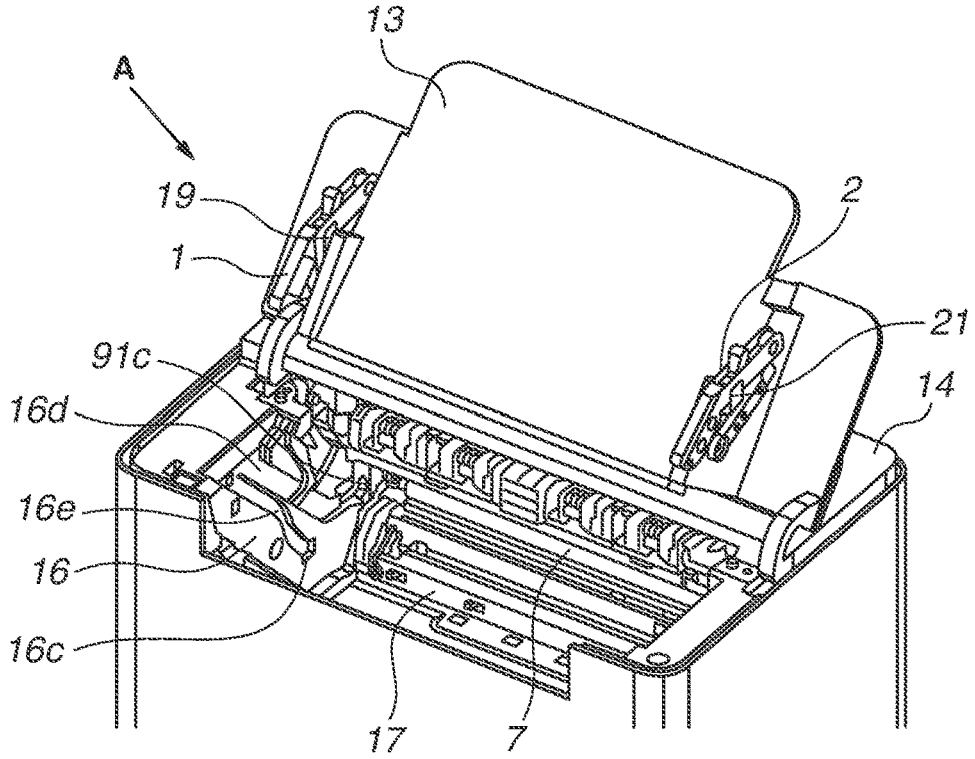
FIG. 2B is a perspective view of the apparatus main body as viewed from a viewpoint different from a viewpoint of FIG. 2A.
Figure 3:
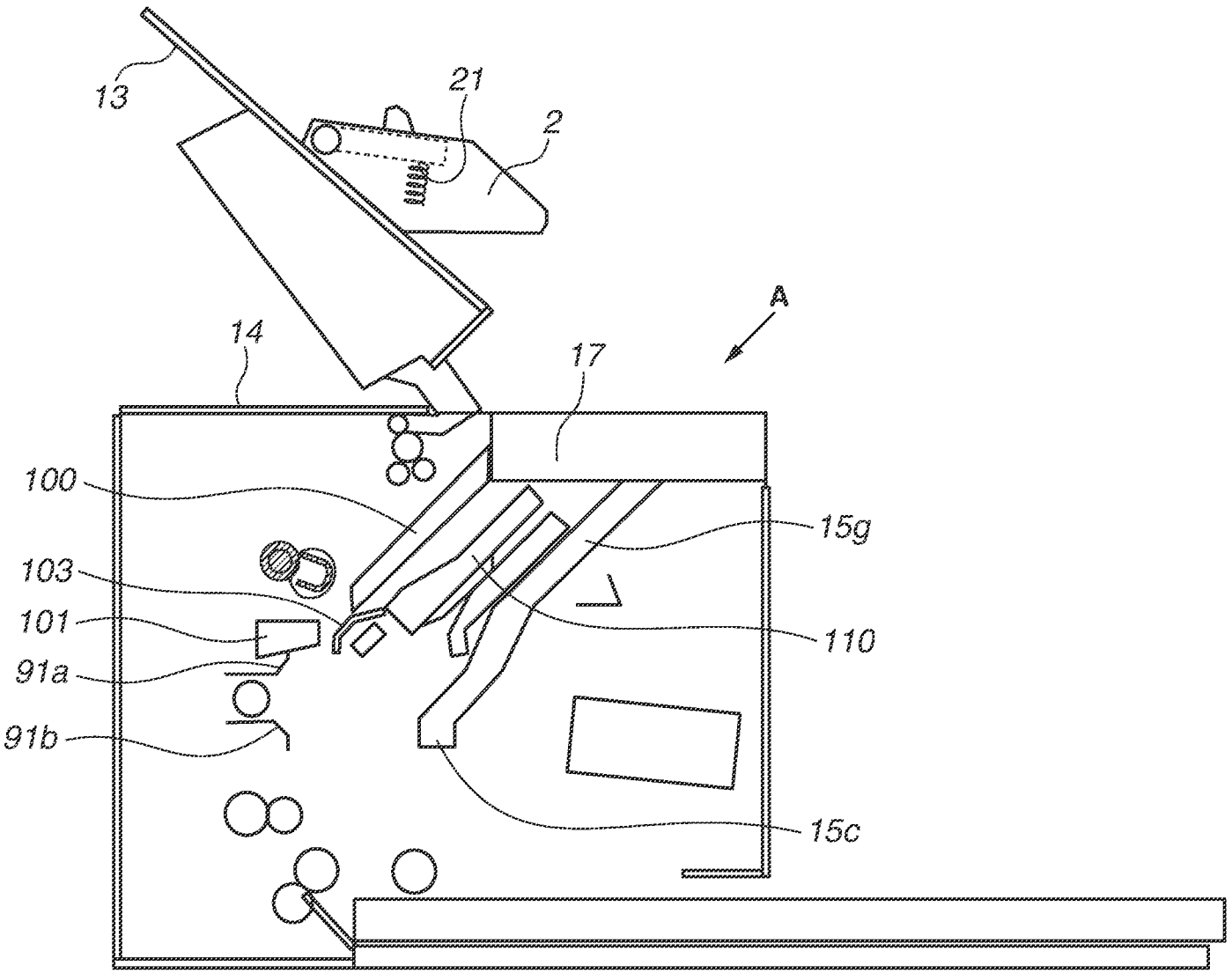
FIG. 3 is a cross-sectional view of the apparatus main body in the state where the opening/closing door is opened.
Figure 6:
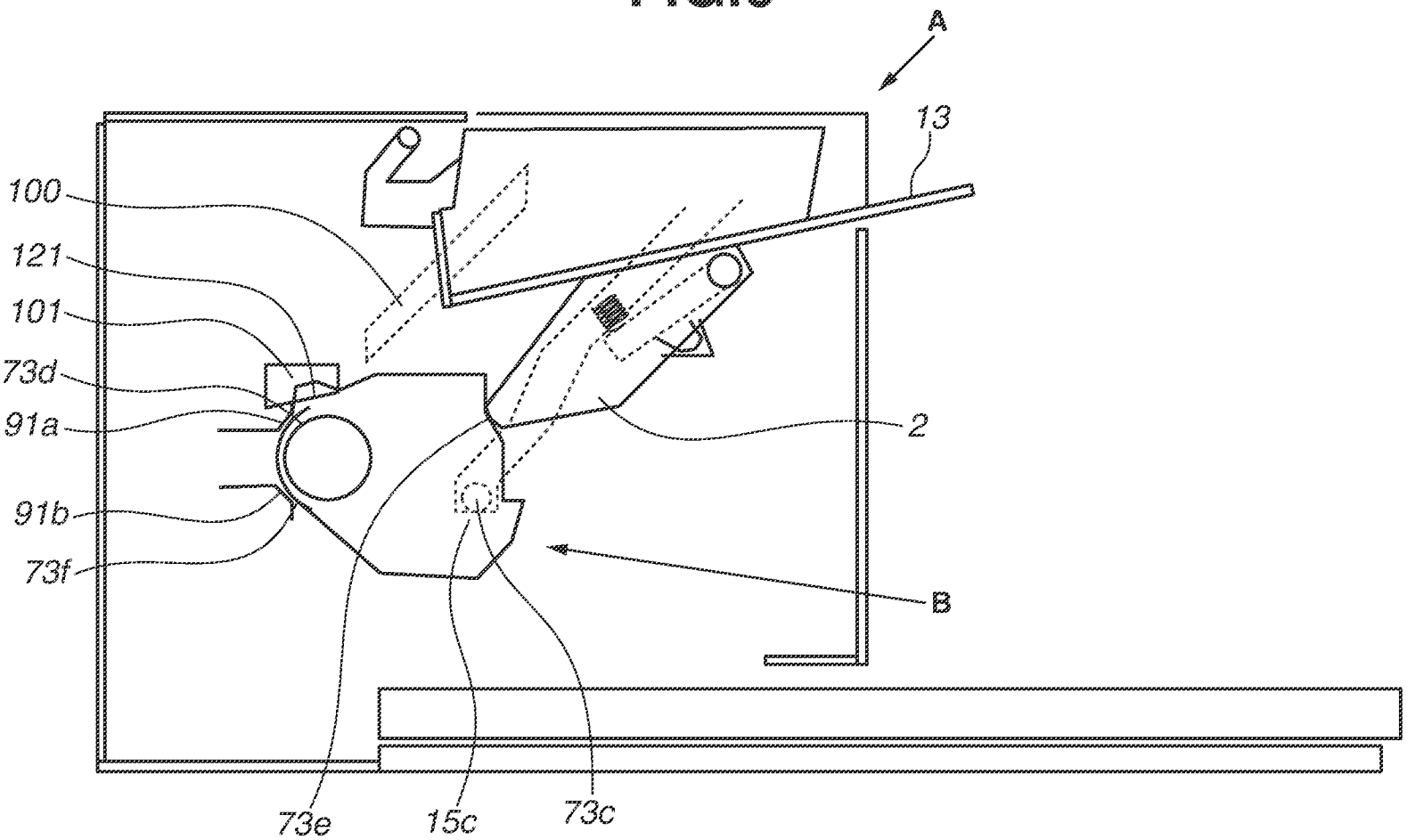
FIG. 6 is a cross-sectional view of the image forming apparatus in a state where the opening/closing door is closed.

A configuration to mount the cartridge B on the apparatus main body A is specifically described with reference to FIGS. 2A and 2B, FIG. 3, and FIG. 6. FIG. 2A is a perspective view of the apparatus main body A in a state where the opening/closing door 13 is opened. FIG. 2B is a perspective view of the apparatus main body A as viewed from a viewpoint different from a viewpoint of FIG. 2A. FIG. 3 is a cross-sectional view of the apparatus main body A in the state where the opening/closing door 13 is opened. FIG. 6 is a cross-sectional view of the image forming apparatus in a state where the opening/closing door 13 is closed. A direction in which the cartridge B is mounted on the apparatus main body A (hereinafter, referred to as mounting direction) is a direction orthogonal to the rotation axis of the drum 62.

An opening/closing structure of the opening/closing door 13 of the apparatus main body A is described. As illustrated in FIGS. 2A and 2B, and FIG. 3, the apparatus main body A includes an opening 17 through which the cartridge B passes when the cartridge B is mounted, the opening/closing door 13, and an upper cover 14. The opening/closing door 13 is movable between a shielding position where the opening/closing door 13 shields the opening 17 and an opening position where the opening/closing door 13 opens the opening 17.

The opening/closing door 13 is pivotably attached to the upper cover 14, and includes cartridge pressing members 1 and 2 and cartridge pressing springs 19 and 21. The cartridge pressing members 1 and 2 are provided at respective end parts of the opening/closing door 13 in a direction orthogonal to the mounting direction. The cartridge pressing springs 19 and 21 are respectively attached to the cartridge pressing members 1 and 2.

To mount the cartridge B on the apparatus main body A, after the opening/closing door 13 is moved from the shielding position to the opening position by being pivoted in a vertically upper direction as illustrated in FIGS. 2A and 2B, and FIG. 3, the cartridge B is inserted into the apparatus main body A from the opening 17.

In the state where the opening/closing door 13 is at the shielding position, mounting of the cartridge B on the apparatus main body A is completed as illustrated in FIG. 6. In this state, pressed portions 73*e* and 710 respectively provided on the drive side and the non-drive side of the cartridge B are pressed in the mounting direction by the cartridge pressing members 1 and 2 with urging force of the cartridge pressing springs 19 and 21, which maintains the position of the cartridge B.

<Positioning of Cartridge in Mounting Direction>

Figure 4A:
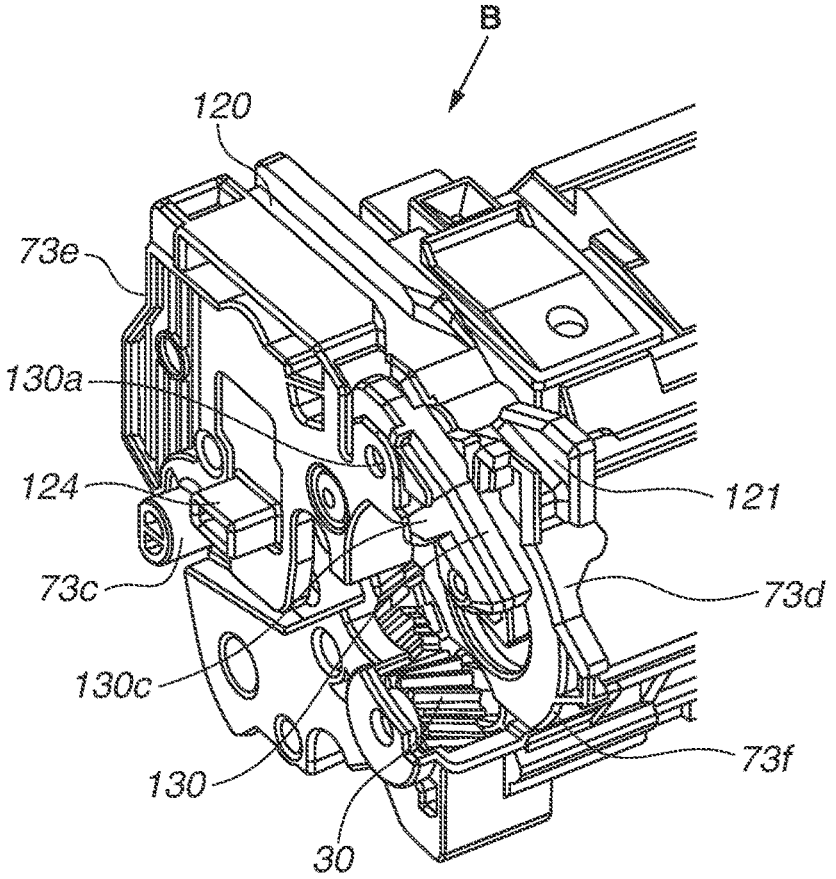
FIG. 4A is a partial perspective view of an end part of a cartridge on a drive side.
Figure 4B:
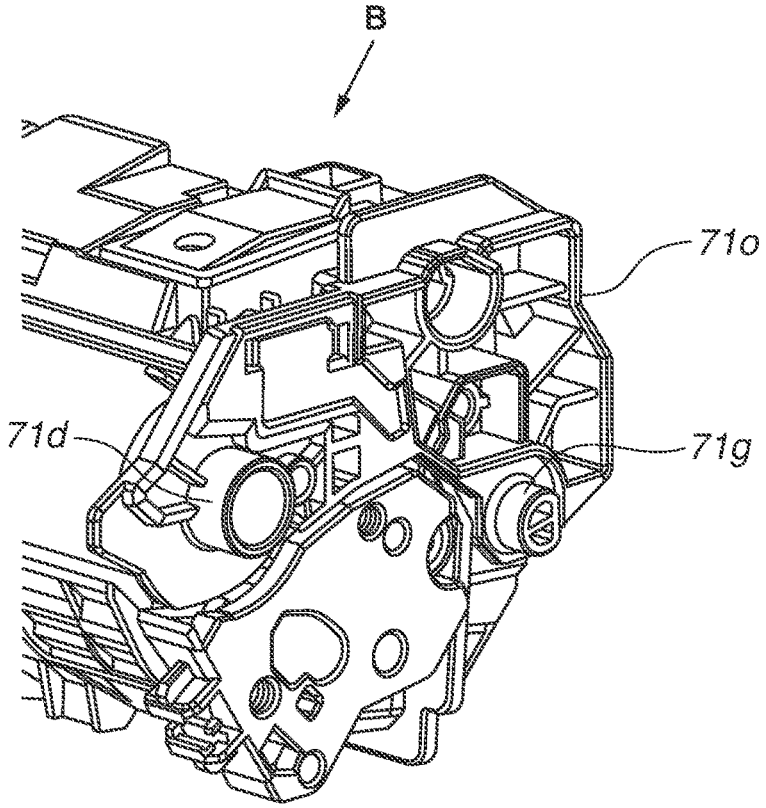
FIG. 4B is a partial perspective view of an end part of the cartridge on a non-drive side.
Figure 5:
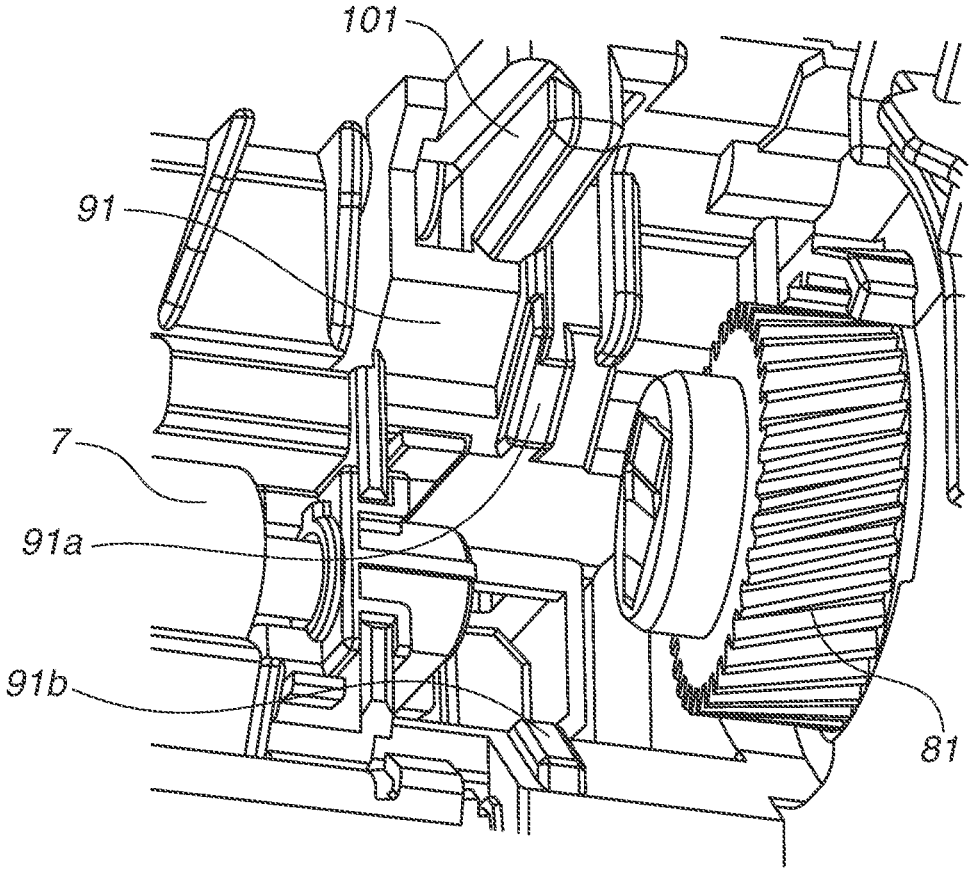
FIG. 5 is a partial perspective view of an end part of the apparatus main body on the drive side.

In the state where the opening/closing door 13 is at the shielding position as illustrated in FIG. 6, the position of the cartridge B relative to the apparatus main body A in the mounting direction is determined. Positioning of the cartridge B relative to the apparatus main body A in the mounting direction is described with reference to FIGS. 4A and 4B. FIG. 4A is a partial perspective view of the end part of the cartridge B on the drive side. FIG. 4B is a partial perspective view of the end part of the cartridge B on the non-drive side. FIG. 5 is a partial perspective view of the end part of the apparatus main body A on the drive side.

The apparatus main body A includes a drive side plate 15 that is a side plate on the drive side, a non-drive side plate 16 that is a side plate on the non-drive side, and a conveyance guide 91 provided with the transfer roller 7, the conveyance roller pair 5*c*, and a conveyance guide (not illustrated).

The drive side plate 15 is provided with a guide rail 15*g* guiding the end part of the cartridge B on the drive side, and a rotation stopping portion 15*c*. The non-drive side plate 16 is provided with a guide rail 16*d* and a guide rail 16*e* guiding the end part of the cartridge B on the non-drive side, and a rotation stopping portion 16*c*.

A first positioning portion 91*a* and a second positioning portion 91*b* as positioning portions for the cartridge B in the mounting direction are provided on the drive side of the conveyance guide 91. A third positioning portion 91*c* is provided on the non-drive side of the conveyance guide 91.

The cartridge B includes a rotation stopped portion 73*c*, an upper portion-to-be-positioned 73*d*, and a lower portion-to-be-positioned 73*f* on the drive side, and includes a portion-to-be-positioned 71*d* and a rotation stopped portion 71*g* on the non-drive side.

When the cartridge B is moved in the mounting direction and is mounted on the apparatus main body A, the rotation stopped portion 73*c* of the cartridge B is guided by the guide rail 15*g* of the apparatus main body A. On the non-drive side of the cartridge B, the portion-to-be-positioned 71*d* and the rotation stopped portion 71*g* of the cartridge B are respectively guided by the guide rail 16*d* and the guide rail 16*e* of the apparatus main body A.

On the drive side, the upper portion-to-be-positioned 73*d*, the lower portion-to-be-positioned 73*f*, and the rotation stopped portion 73*c* of the cartridge B respectively abut on the first positioning portion 91*a*, the second positioning portion 91*b*, and the rotation stopping portion 15*c* of the apparatus main body A. Further, on the non-drive side, the portion-to-be-positioned 71*d* and the rotation stopped portion 71*g* of the cartridge B respectively abut on the third positioning portion 91*c* and the rotation stopping portion 16*c* of the apparatus main body A. As a result, in a state where mounting of the cartridge B on the apparatus main body A is completed, the position of the cartridge B relative to the apparatus main body A in the mounting direction is determined on the drive side and the non-drive side.

<Positioning of Cartridge in Direction Orthogonal to Mounting Direction>

In the state where the opening/closing door 13 is at the shielding position as illustrated in FIG. 6, the position of the cartridge B relative to the apparatus main body A in the direction orthogonal to the mounting direction is determined. Positioning of the cartridge B relative to the apparatus main body A in the direction orthogonal to the mounting direction is described with reference to FIG. 5. FIG. 5 is a perspective view illustrating a vicinity of a fitting portion 101 of the apparatus main body A on the drive side in an enlarged manner.

The conveyance guide 91 of the apparatus main body A includes the fitting portion 101 as a positioning portion in the direction orthogonal to the mounting direction. The fitting portion 101 according to the present exemplary embodiment is a rib (convex portion) that protrudes in a direction approaching the cartridge B in the direction orthogonal to the mounting direction and extends in the mounting direction.

On the other hand, as illustrated in FIG. 4A, the cartridge B includes a fitted portion 121 as a portion-to-be-positioned on the drive side. The fitted portion 121 according to the present exemplary embodiment is a groove between two ribs protruding from an outer surface of the cartridge B.

When the fitting portion 101 of the apparatus main body A and the fitted portion 121 of the cartridge B are fitted to each other in the state where mounting of the cartridge B on the apparatus main body A is completed, the position of the cartridge B relative to the apparatus main body A in the direction orthogonal to the mounting direction is determined.

<Regulating portion Regulating Movement of Cartridge>

Figure 8:
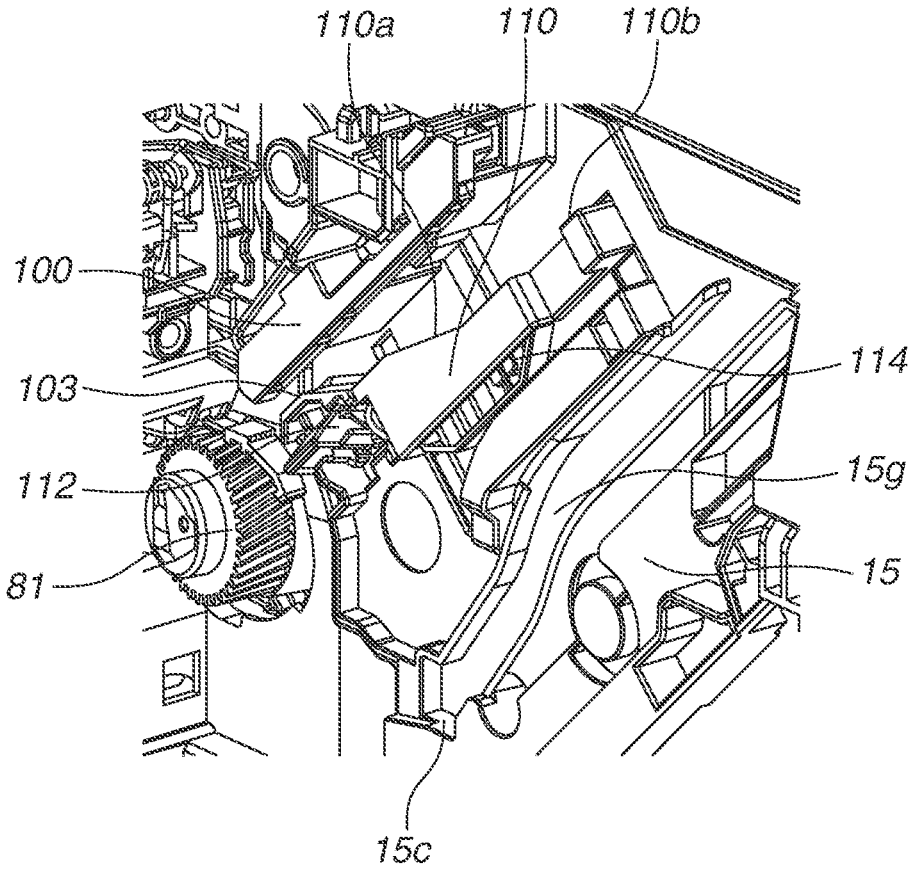
FIG. 8 is an enlarged perspective view illustrating a vicinity of a regulating portion of the apparatus main body on the drive side.

A regulating portion regulating movement of the cartridge in the direction orthogonal to the mounting direction, as a characteristic configuration of the present exemplary embodiment, is described with reference to FIGS. 4A and 4B, FIG. 6, and FIG. 8. FIG. 8 is an enlarged perspective view illustrating a vicinity of a regulating portion 100 on the drive side of the apparatus main body A.

The image forming apparatus is configured to regulate movement of the cartridge B in the direction orthogonal to the mounting direction before mounting of the cartridge B on the apparatus main body A is completed and before the fitting portion 101 and the fitted portion 121 are fitted to each other.

As illustrated in FIG. 6 and FIG. 8, the apparatus main body A includes the regulating portion 100 on an upstream side of the fitting portion 101 in the mounting direction. The regulating portion 100 includes a rib that protrudes in the direction approaching the cartridge B in the direction orthogonal to the mounting direction and extends in the mounting direction. When viewed from the mounting direction, the regulating portion 100 is disposed so as to be overlapped with the positioning portion 101 in the direction orthogonal to the mounting direction.

As illustrated in FIG. 4A and FIG. 8, the cartridge B includes a portion-to-be-regulated 120 on an upstream side of the fitted portion 121 in the mounting direction. The portion-to-be-regulated 120 includes a groove that is recessed in the direction orthogonal to the mounting direction and extends in the mounting direction. When viewed from the mounting direction, the portion-to-be-regulated 120 is disposed so as to be overlapped with the fitted portion 121 in the direction orthogonal to the mounting direction.

The regulating portion 100 and the portion-to-be-regulated 120 engage with each other before mounting of the cartridge B on the apparatus main body A is completed and before the fitting portion 101 and the fitted portion 121 are fitted to each other. This regulates movement of the cartridge B relative to the apparatus main body A in the direction orthogonal to the mounting direction. As a result, it is possible to stabilize a posture of the cartridge B before mounting of the cartridge B on the apparatus main body A is completed and before the portion-to-be-positioned of the cartridge B and the positioning portion of the apparatus main body A engage with each other.

Further, in the state where mounting of the cartridge B on the apparatus main body A is completed as illustrated in FIG. 6, the portion-to-be-regulated 120 of the cartridge B does not engage with the regulating portion 100 of the apparatus main body A. The state where the portion-to-be-regulated 120 does not engage with the regulating portion 100 indicates a state where the portion-to-be-regulated 120 and the regulating portion 100 are not overlapped with each other when viewed from the direction orthogonal to the mounting direction. Therefore, in the state where mounting of the cartridge B on the apparatus main body A is completed, the position of the cartridge B in the direction orthogonal to the mounting direction is determined by fitting of the fitting portion 101 of the apparatus main body A and the fitted portion 121 of the cartridge B. Further, in the state where mounting of the cartridge B on the apparatus main body A is completed, the regulating portion 100 and the portion-to-be-regulated 120 do not influence positioning of the cartridge B.

<Cartridge Interlocking Mechanism>

Figure 7A:
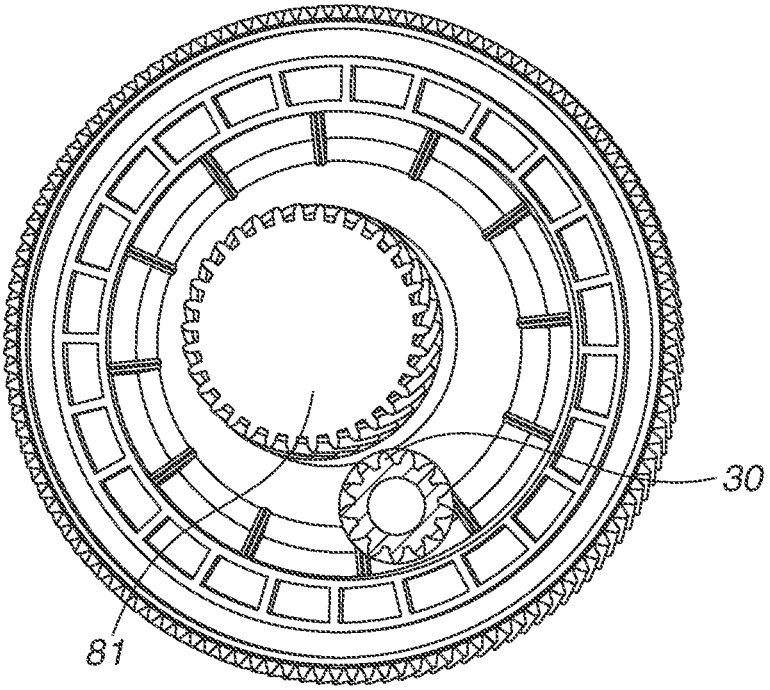
FIG. 7A is a diagram illustrating positional relationship between a driving gear of the apparatus main body and a driven gear when the driving gear is at a non-engagement position.
Figure 7B:
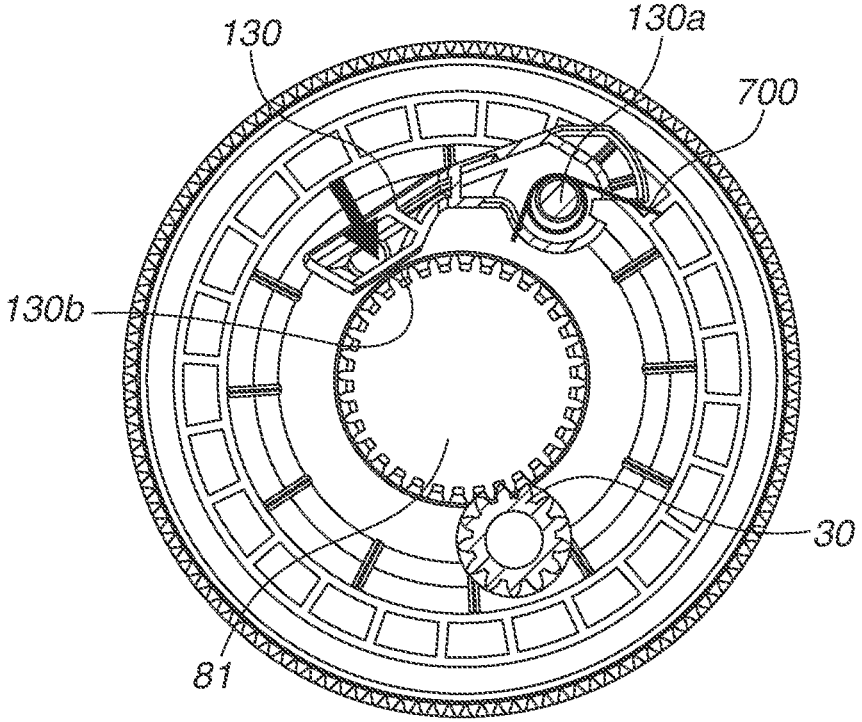
FIG. 7B is a diagram illustrating the positional relationship between the driving gear of the apparatus main body and the driven gear when the driving gear is at an engagement position.
Figure 9:
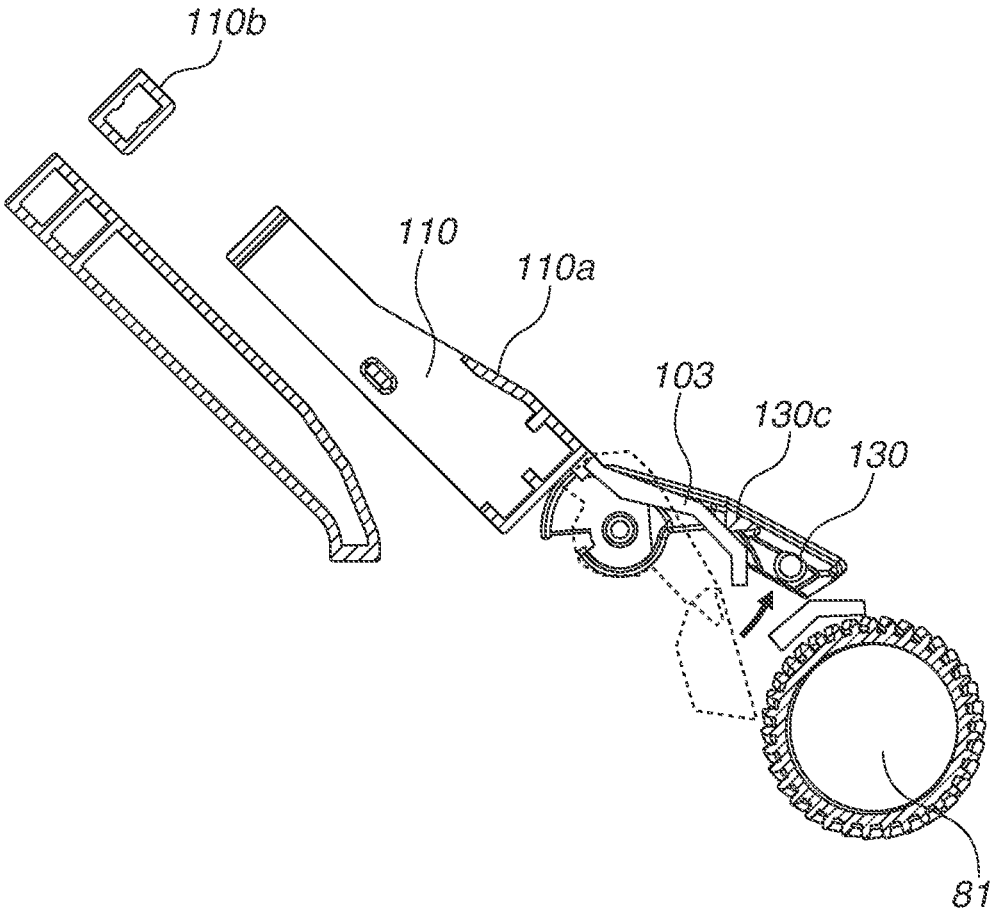
FIG. 9 is a diagram illustrating positional relationship between a moving member and a guide portion in the middle of mounting the cartridge on the apparatus main body.
Figure 12A:
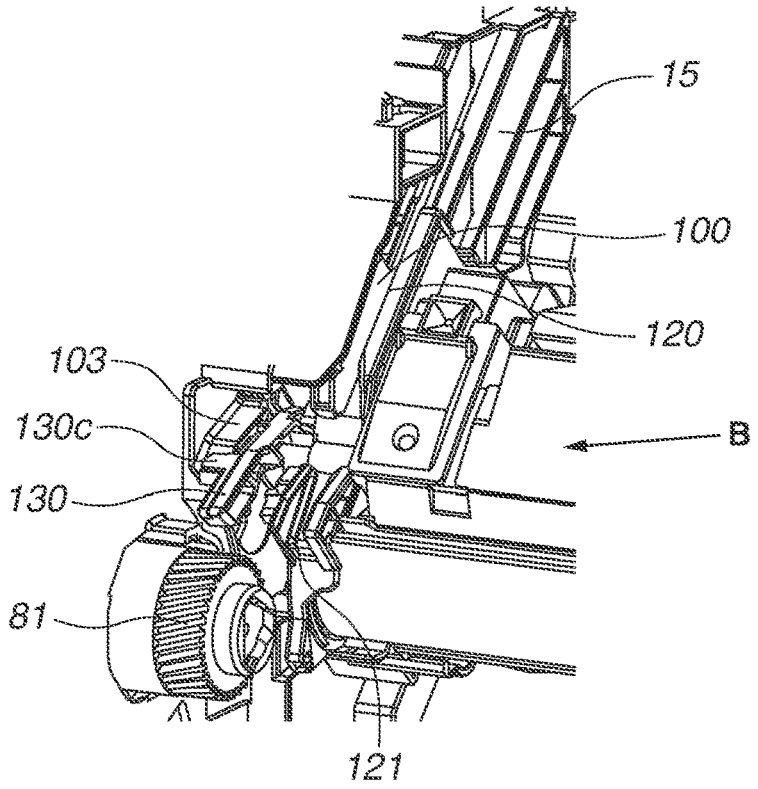
FIG. 12A is an enlarged perspective view illustrating a vicinity of a lever and a second guide member when the lever is guided by the second guide member.

A cartridge interlocking mechanism interlocking with operation to mount/demount the cartridge B on/from the apparatus main body A is described with reference to FIGS. 4A and 4B, FIG. 5, FIGS. 7A and 7B, FIG. 8, and FIG. 9. FIG. 7A is a diagram illustrating positional relationship between a driving gear 81 of the apparatus main body A and a driven gear when the driving gear 81 is at a non-engagement position. FIG. 7B is a diagram illustrating the positional relationship between the driving gear 81 of the apparatus main body A and the driven gear when the driving gear 81 is at an engagement position. FIG. 9 is a diagram illustrating positional relationship between a moving member and a first guide member 110 in the middle of mounting the cartridge B on the apparatus main body A. FIG. 12A is an enlarged perspective view illustrating a vicinity of a lever 130 and a second guide member 103 when the lever 130 is guided by the second guide member 103.

As illustrated in FIG. 5, the apparatus main body A includes, on the drive side, the driving gear 81 as a driving force transmission member transmitting driving force to the cartridge B. In contrast, as illustrated in FIG. 4A, the cartridge B includes, on the drive side, a driven gear 30 that is rotated by receiving the driving force from the driving gear 81 of the apparatus main body A.

The driving gear 81 of the apparatus main body A is configured to swing (move) between the non-engagement position (FIG. 7A) where the driving gear 81 does not engage with the driven gear 30 of the cartridge B and the engagement position (FIG. 7B) where the driving gear 81 engages with the driven gear 30 of the cartridge B and can transmit the driving force to the driven gear 30.

The driving gear 81 of the apparatus main body A is at the non-engagement position in the state where the cartridge B is not mounted, and is at the engagement position in the state where mounting of the cartridge B on the apparatus body A is completed.

A configuration causing the driving gear 81 to move between the engagement position and the non-engagement position as described above is described.

As illustrated in FIG. 4A, the cartridge B includes the lever 130 (moving member) on the drive side. The lever 130 moves by interlocking with mounting/demounting of the cartridge B on/from the apparatus main body A. As illustrated in FIG. 7B, the lever 130 is configured to pivot around a pivot fulcrum 130*a*, and includes a pressing portion 130*b* pressing the driving gear 81. The lever 130 is configured to pivot (move) between a pressing position (FIG. 7B) where the pressing portion 130*b* presses the driving gear 81 and a retracted position (FIG. 7A) where the pressing portion 130*b* is retracted from the pressing position. A pivot axis of the lever 130 extends in the direction orthogonal to the mounting direction. Further, the lever 130 is urged by an urging member 700 (torsion coil spring) in an arrow direction (direction in which the lever 130 moves from the retracted position to the pressing position) in FIG. 7B.

Next, a configuration of the apparatus main body A causing the lever 130 to pivot is described. As illustrated in FIG. 8, the first guide member 110 and the second guide member 103 guiding the lever 130 so as to cause the lever 130 to pivot are provided on the drive side plate 15 of the apparatus main body A on the drive side. The first guide member 110 includes a first guide portion 110*b* and a second guide portion 110*a* provided on a downstream side of the first guide portion 110*b* in the mounting direction. The lever 130 includes a guided portion 130*c* that abuts on and is guided by the first guide member 110 and the second guide member 103 when the cartridge B is moved relative to the apparatus main body A in the mounting direction as illustrated in FIG. 9. As illustrated in FIG. 12A, the guided portion 130*c* is a protrusion protruding from a side surface of the lever 130 in a direction of the pivot axis of the lever 130.

The lever 130 abuts on the first guide member 110 and the second guide member 103 and pivots while the cartridge B is guided by the guide rail 15*g*, the guide rail 16*d*, and the guide rail 16*e* of the apparatus main body A and is moved in the mounting direction. The lever 130 pivots in an arrow direction in FIG. 9. As a result, the lever 130 is moved from the pressing position to the retracted position against the urging force of the urging member 700. As a result, the cartridge B is moved in the mounting direction without interference of the lever 130 with the driving gear 81, and mounting of the cartridge B on the apparatus main body A is completed. At the time when mounting of the cartridge B on the apparatus main body A is completed, the guided portion 130*c* of the lever 130 has passed the second guide member 103. Accordingly, the lever 130 is moved from the retracted position to the pressing position by the urging force of the urging member 700, and the pressing portion 130*b* presses the driving gear 81 to position the driving gear 81 at the engagement position.

<Main Body Interlocking Mechanism>

Next, a main body interlocking mechanism interlocking with mounting/demounting of the cartridge B on/from the apparatus main body A is described with reference to FIGS. 4A and 4B, FIG. 8, FIGS. 10A and 10B, and FIGS. 11A and 11B. The main body interlocking mechanism of the apparatus main body A is provided on the drive side plate 15 of the apparatus main body A, and includes a regulating member 112, an interlocking member 114, the first guide member 110, a torsion coil spring 113, and a compression coil spring 115.

Figure 10A:
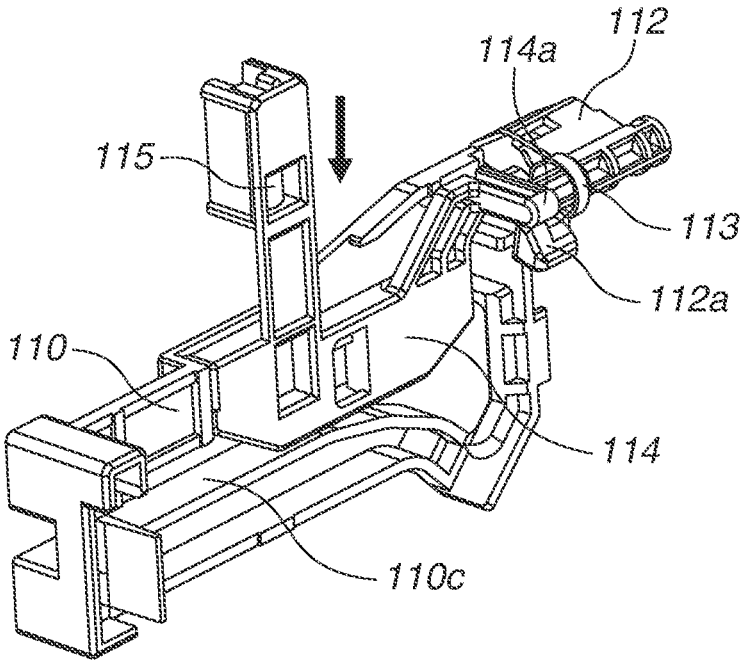
FIG. 10A is a perspective view of a main body interlocking mechanism when a regulating member is at a regulating position.
Figure 10B:
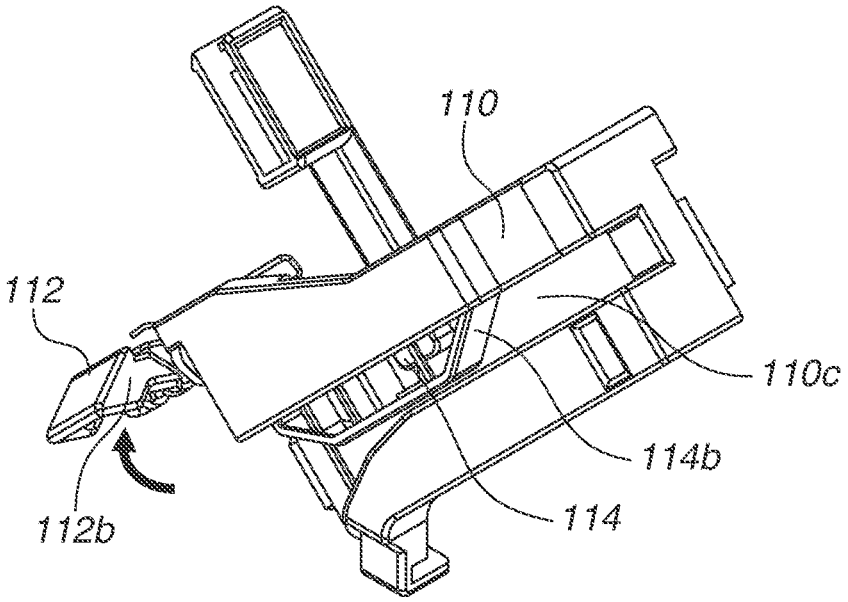
FIG. 10B is a perspective view of the main body interlocking mechanism as viewed from a viewpoint different from a viewpoint of FIG. 10A.
Figure 11A:
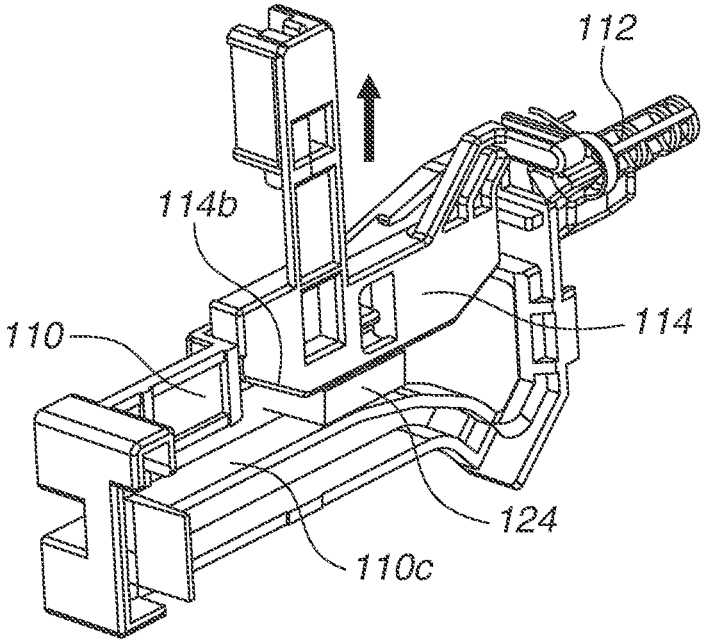
FIG. 11A is a perspective view of the main body interlocking mechanism when the regulating member is at an allowing position.
Figure 11B:
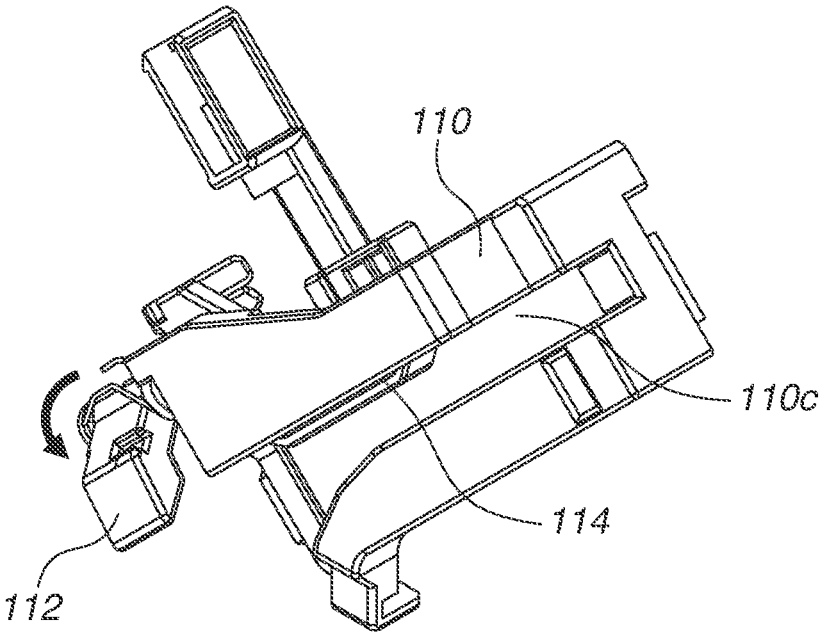
FIG. 11B is a perspective view of the main body interlocking mechanism as viewed from a viewpoint different from a viewpoint of FIG. 11A.

FIG. 10A is a perspective view of the main body interlocking mechanism when the regulating member 112 is at a regulating position. FIG. 10B is a perspective view of the main body interlocking mechanism as viewed from a viewpoint different from a viewpoint of FIG. 10A. FIG. 11A is a perspective view of the main body interlocking mechanism when the regulating member 112 is at an allowing position. FIG. 11B is a perspective view of the main body interlocking mechanism as viewed from a viewpoint different from a viewpoint of FIG. 11A. The regulating member 112 is configured to be rotatable between the regulating position (FIGS. 10A and 10B) where the regulating member 112 regulates mounting of the cartridge B on the apparatus main body A and the allowing position (FIGS. 11A and 11B) where the regulating member 112 allows mounting of the cartridge B on the apparatus main body A. The regulating member 112 includes a first abutted portion 112*a*. The regulating member 112 is urged by the torsion coil spring 113 (first urging member) in a direction in which the regulating member 112 moves from the regulating position to the allowing position.

The interlocking member 114 is configured to be movable between a first position (FIGS. 10A and 10B) and a second position (FIGS. 11A and 11B) above the first position, by interlocking with the regulating member 112. The interlocking member 114 includes a first abutting portion 114*a* abutting on the first abutted portion 112*a* of the regulating member 112. The interlocking member 114 is urged by the compression coil spring 115 (second urging member) in a direction (arrow direction in FIG. 10A) in which the interlocking member 114 moves from the second position to the first position.

The cartridge B includes a boss 124 (second abutting portion) abutting on an inclined surface portion 114*b* (second abutted portion) of the interlocking member 114 of the apparatus main body A, on the drive side of the apparatus main body A provided with the main body interlocking mechanism. The boss 124 extends in the direction orthogonal to the mounting direction of the cartridge B.

Next, movement of the main body interlocking mechanism is described. In a state before the cartridge B is mounted on the apparatus main body A, the interlocking member 114 is urged by urging force of the compression coil spring 115 in the arrow direction of FIG. 10A (direction from the second position toward the first position) and is at the first position. At this time, a boss passing portion 110*c* as a passage for the boss 124 of the cartridge B, provided in the first guide member 110 is blocked by the interlocking member 114. Further, urging force of the torsion coil spring 113 is set to urging force weaker than the urging force of the compression coil spring 115. Therefore, the first abutted portion 112*a* of the regulating member 112 is pushed down by the first abutting portion 114*a* of the interlocking member 114. As a result, the regulating member 112 is disposed at the regulating position by receiving force from the interlocking member 114 in an arrow direction (direction from the allowing position to the regulating position) of FIG. 10B against the urging force of the torsion coil spring 113.

In the process of mounting the cartridge B on the apparatus main body A, the boss 124 of the cartridge B enters the boss passing portion 110*c* of the first guide member 110 and abuts on the inclined surface portion 114*b* of the interlocking member 114 as illustrated in FIG. 11A. As a result, the interlocking member 114 is moved in an arrow direction (direction from the first position to the second position) illustrated in FIG. 11A against the urging force of the compression coil spring 115. When the interlocking member 114 is moved, the urging force to the first abutted portion 112*a* of the regulating member 112 is weakened. Therefore, the regulating member 112 pivots by the urging force of the torsion coil spring 113 in an arrow direction of FIG. 11B. As a result, the regulating member 112 is moved to the allowing position, and the cartridge B becomes mountable on the apparatus main body A.

In the present exemplary embodiment, the regulating member 112 and the interlocking member 114 are configured as different members interlocking with each other; however, the regulating member 112 and the interlocking member 114 are not limited thereto. A member obtained by integrating the regulating member 112 and the interlocking member 114 may move from the regulating position to the allowing position by abutting on the boss 124 of the cartridge B, thereby allowing mounting of the cartridge B on the apparatus main body A.

<Regulating Portion and Cartridge Interlocking Mechanism>

Figure 12B:
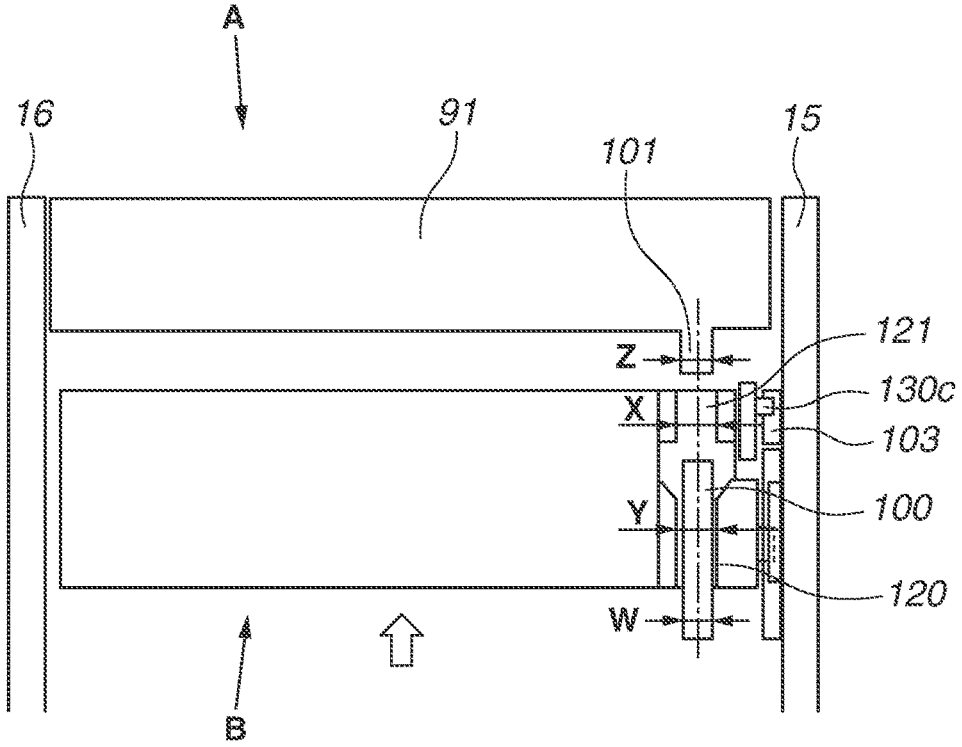
FIG. 12B is a diagram illustrating a position of the regulating portion when the lever is guided by the second guide member.
Figure 13A:
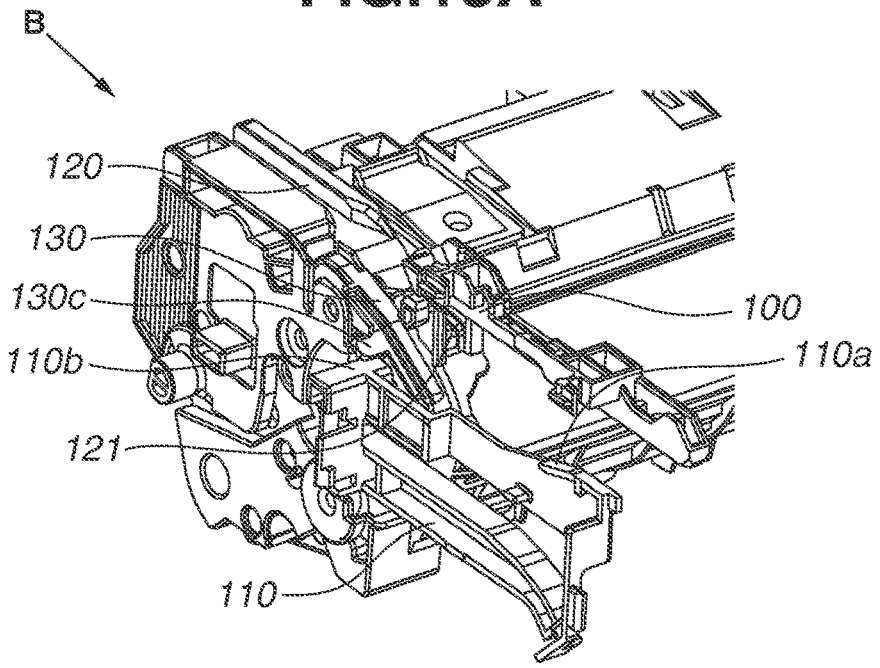
FIG. 13A is an enlarged perspective view illustrating a vicinity of the regulating portion and a first guide member when the lever is guided by the first guide member.
Figure 13B:
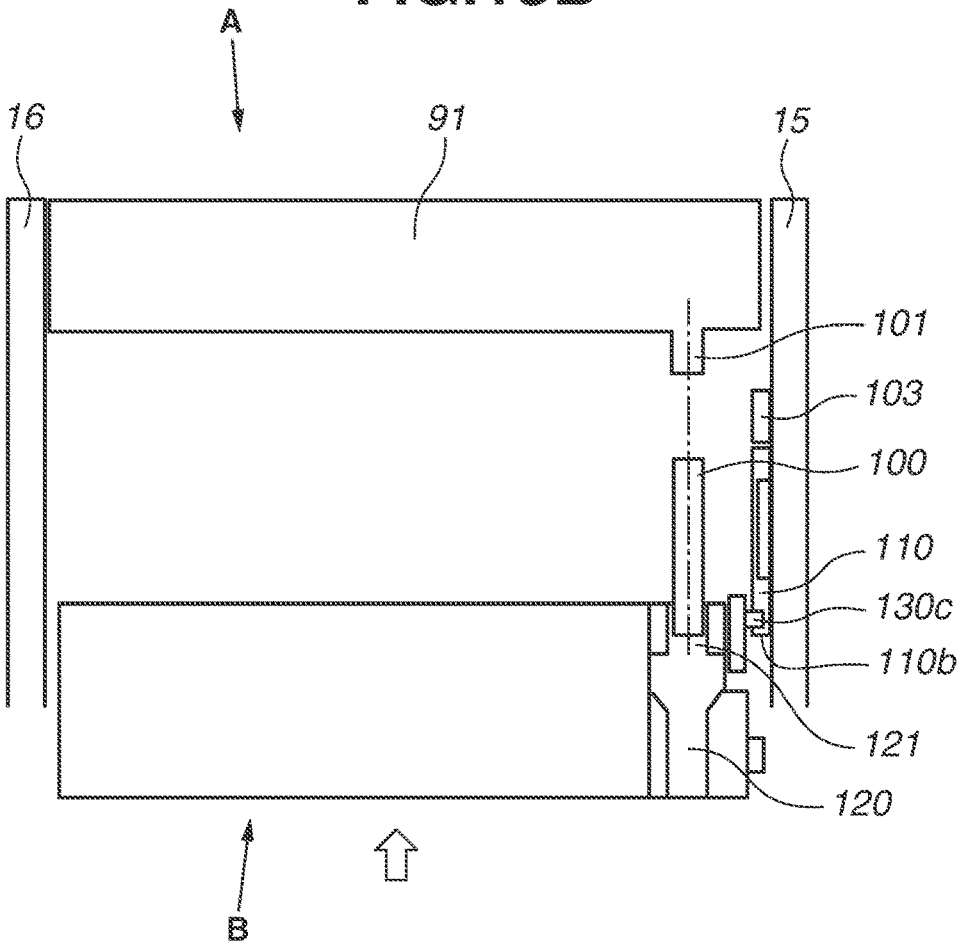
FIG. 13B is a diagram illustrating the position of the regulating portion when the lever is guided by the first guide member.

Relationship between the regulating portion 100 and the cartridge interlocking mechanism is described. FIG. 12B is a diagram illustrating a position of the regulating portion 100 when the lever 130 is guided by the second guide member 103. FIG. 13A is an enlarged perspective view illustrating a vicinity of the regulating portion 100 and the first guide member 110 when the lever 130 is guided by the first guide member 110. FIG. 13B is a diagram illustrating the position of the regulating portion 100 when the lever 130 is guided by the first guide member 110.

As illustrated in FIG. 12B, a state where the guided portion 130*c* of the lever 130 of the cartridge B abuts on and is guided by the second guide member 103 of the apparatus main body A before the fitted portion 121 of the cartridge B is fitted to the fitting portion 101 of the apparatus main body A, is described.

The regulating portion 100 of the apparatus main body A regulates movement of the cartridge B relative to the apparatus main body A in the direction orthogonal to the mounting direction by engaging with the portion-to-be-regulated 120 of the cartridge B. Accordingly, even when the cartridge B is shifted or inclined to the driven side, an engagement amount of the guided portion 130*c* of the lever 130 and the second guide member 103 in the direction orthogonal to the mounting direction is stably secured. As a result, it is possible to prevent the lever 130 from contacting with the driving gear 81 by the fact that the guided portion 130*c* of the lever 130 does not engage with the second guide member 103 to inhibit the lever 130 from moving to the retracted position, and to prevent occurrence of mounting failure of the cartridge B.

Next, a state where the guided portion 130*c* of the lever 130 abuts on and is guided by the first guide portion 110*b* of the first guide member 110 of the apparatus main body A before the fitted portion 121 of the cartridge B engages with the fitting portion 101 of the apparatus main body A as described in FIGS. 13A and 13B is described. At this time, the regulating portion 100 of the apparatus main body A regulates movement of the cartridge B relative to the apparatus main body A in the direction orthogonal to the mounting direction by engaging with the fitted portion 121 of the cartridge B. Accordingly, even when the cartridge B is shifted or inclined to the driven side at this time, an engagement amount of the guided portion 130*c* of the lever 130 and the first guide portion 110*b* in the direction orthogonal to the mounting direction is stably secured. As a result, it is possible to prevent the guided portion 130*c* of the lever 130 from becoming unengageable with the second guide portion 110*a* and the second guide member 103 after the guided portion 130*c* of the lever 130 becomes unengageable with the first guide portion 110*b*.

As illustrated in FIG. 12B, in the present exemplary embodiment, a width X of the fitted portion 121 is equal to a width Y of the portion-to-be-regulated 120, and a width Z of the fitting portion 101 is greater than a width W of the regulating portion 100 in the direction orthogonal to the mounting direction. However, the widths are not limited thereto, and the width X of the fitted portion 121 may be greater than the width Y of the portion-to-be-regulated 120, and the width Z of the fitting portion 101 may be equal to the width W of the regulating portion 100.

<Regulating Portion and Main Body Interlocking Mechanism>

Figure 14A:
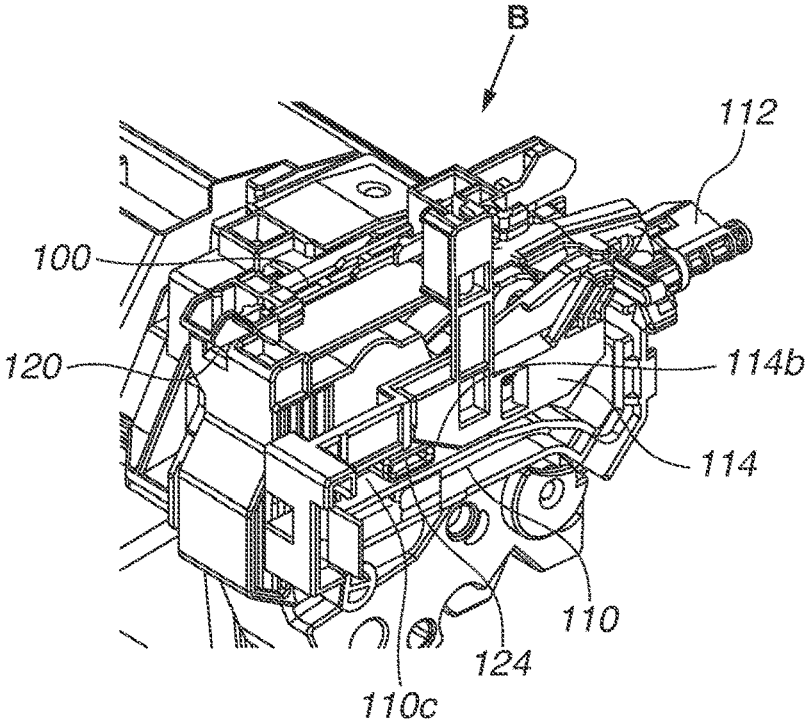
FIG. 14A is a perspective view illustrating a vicinity of the regulating portion and an interlocking member when a boss of the cartridge abuts on the interlocking member.
Figure 14B:
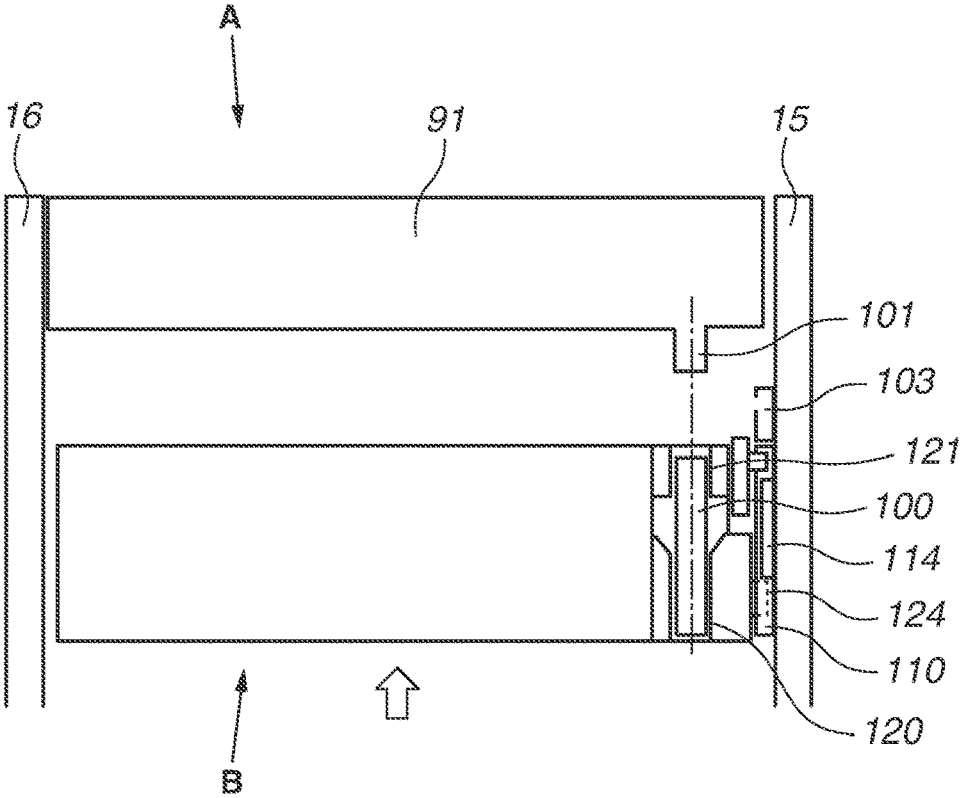
FIG. 14B is a diagram illustrating the position of the regulating portion when the boss of the cartridge abuts on the interlocking member.

Relationship between the regulating portion 100 and the main body interlocking mechanism is described. FIG. 14A is a perspective view illustrating a vicinity of the regulating portion 100 and the interlocking member 114 when the boss 124 of the cartridge B abuts on the interlocking member 114. FIG. 14B is a diagram illustrating the position of the regulating portion 100 when the boss 124 of the cartridge B abuts on the interlocking member 114.

When the boss 124 of the cartridge B abuts on the inclined surface portion 114*b* of the interlocking member 114 (see FIG. 11A), the regulating portion 100 of the apparatus main body A engages with the portion-to-be-regulated 120 of the cartridge B. This regulates movement of the cartridge B relative to the apparatus main body A in the direction orthogonal to the mounting direction. Accordingly, even when the cartridge B is shifted or inclined to the driven side at this time, an engagement amount of the boss 124 and the inclined surface portion 114*b* in the direction orthogonal to the mounting direction is stably secured. As a result, it is possible to prevent occurrence of mounting failure in which the interlocking member 114 does not move due to non-engagement of the boss 124 and the interlocking member 114, and mounting of the cartridge B is inhibited by the regulating member 112 at the regulating position.

As illustrated in FIGS. 12B, 13B, and 14B, the regulating portion 100 is disposed so as to be overlapped with the fitting portion 101 in the direction orthogonal to the mounting direction when viewed from the mounting direction. When viewed from the mounting direction, the portion-to-be-regulated 120 is disposed so as to be overlapped with the fitted portion 121 in the direction orthogonal to the mounting direction. As a result, during operation of each of the cartridge interlocking mechanism and the main body interlocking mechanism in the process of mounting the cartridge B on the apparatus main body A, the regulating portion 100 can engage with at least one of the portion-to-be-regulated 120 and the fitted portion 121 of the cartridge B. Accordingly, even when the cartridge B is shifted or inclined to the driven side in the process of mounting the cartridge B on the apparatus main body A, it is possible to avoid operation failure due to insufficient engagement amount with the cartridge interlocking mechanism or the main body interlocking mechanism.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-102029, filed Jun. 12, 2020, which is hereby incorporated by reference herein in its entirety.

What is claimed is:

1. An image forming apparatus, comprising:

a cartridge including a rotating member rotatable about a rotation axis and a portion-to-be-positioned; and an apparatus main body on which the cartridge is mounted in a mounting direction orthogonal to the rotation axis, the apparatus main body including a positioning portion and a regulating portion, the positioning portion being configured to position the cartridge in a direction of the rotation axis by engaging with the portion-to-be-positioned of the cartridge when mounting of the cartridge on the apparatus main body is completed, the regulating portion being provided on an upstream side of the positioning portion in the mounting direction, wherein the cartridge includes a portion-to-be-regulated provided on an upstream side of the portion-to-be-positioned in the mounting direction, wherein the portion-to-be-positioned of the cartridge engages with the regulating portion of the apparatus main body before engaging with the positioning portion of the apparatus main body, so that movement of the cartridge in the direction of the rotation axis is regulated, and wherein the portion-to-be-regulated of the cartridge engages with the regulating portion, before the portion-to-be-positioned engages with the positioning portion of the apparatus main body, so that movement of the cartridge in the direction of the rotation axis is regulated.

2. The image forming apparatus according to claim 1, wherein, when mounting of the cartridge on the apparatus main body is completed, neither the portion-to-be-positioned nor the portion-to-be-regulated of the cartridge engages with the regulating portion.

3. The image forming apparatus according to claim 1, wherein the apparatus main body includes a moving member configured to be movable between a regulating position where the moving member regulates mounting of the cartridge on the apparatus main body and an allowing position where the moving member allows mounting of the cartridge on the apparatus main body, the moving member including an abutted portion, wherein the cartridge includes an abutting portion configured to abut on the abutted portion when the cartridge is mounted on the apparatus main body, to move the moving member from the regulating position to the allowing position, and wherein the portion-to-be-regulated of the cartridge engages with the regulating portion of the apparatus main body when the abutting portion of the cartridge abuts on the abutted portion of the moving member.

4. The image forming apparatus according to claim 3, wherein the moving member and the regulating portion are provided at an end part of the apparatus main body in the direction of the rotation axis, and wherein the portion-to-be-regulated of the cartridge is provided at an end part of the cartridge on a side of the end part of the apparatus main body in the direction of the rotation axis.

5. The image forming apparatus according to claim 1, wherein the rotating member is a roller configured to carry toner and a driving force reception member configured to receive driving force rotating the roller, wherein the apparatus main body includes a driving force transmission member configured to transmit the driving force to the driving force reception member of the cartridge by engaging the driving force reception member, the driving force transmission member being movable between an engagement position where the driving force transmission member engages with the driving force reception member and an non-engagement position where the driving force transmission member does not engage with the driving force reception member, wherein the cartridge includes a frame, a pressing member, and an urging member, the pressing member being configured to be movable, relative to the frame, between a first position where the pressing member presses the driving force transmission member to move the driving force transmission member of the apparatus main body from the non-engagement position to the engagement position, and a second position different from the first position, the urging member being configured to urge the pressing member in a direction in which the pressing member moves from the second position to the first position, wherein the apparatus main body includes a guide member configured to guide the pressing member by coming into contact with the pressing member, the guide member being configured to guide the pressing member to move the pressing member from the first position to the second position before mounting of the cartridge on the apparatus main body is completed, the guiding member being configured not to come into contact with the pressing member when mounting of the cartridge on the apparatus main body is completed, and wherein the portion-to-be-regulated of the cartridge engages with the regulating portion of the apparatus main body when the pressing member is guided by the guide member.

6. The image forming apparatus according to claim 1, wherein the positioning portion is configured to position the cartridge, in a first direction paralleled with the direction of the rotation axis and a second direction opposite to the first direction, by engaging with the portion-to-be-positioned of the cartridge when mounting of the cartridge on the apparatus main body is completed.

7. The image forming apparatus according to claim 6, wherein the portion-to-be-positioned of the cartridge engages with the regulating portion of the apparatus main body so that movement of the cartridge in the first direction and the second direction is regulated.

8. The image forming apparatus according to claim 1, wherein the portion-to-be-positioned and the portion-to-be-regulated of the cartridge are first and second grooves, respectively, the first and second grooves being recessed in a direction orthogonal to the mounting direction and extends in the mounting direction.

9. The image forming apparatus according to claim 8, wherein a width of the first groove in the direction of the rotation axis is the same as the width of the second groove in the direction of the rotation axis, and wherein the positioning portion and the regulating portion are first and second ribs, respectively, and a width of the first rib in the direction of the rotation axis is greater than a width of the second rib in the direction of the rotation axis.

10. A cartridge mountable/demountable on/from an apparatus main body of an image forming apparatus, the apparatus main body including a positioning portion and a regulating portion, the cartridge comprising:

a photosensitive drum configured to be rotatable around a rotation axis;

a portion-to-be-positioned configured to be engaged with the positioning portion of the apparatus main body so that the cartridge is positioned relative to the apparatus main body in a direction of the rotation axis; and a portion-to-be-regulated provided at a position farther from the photosensitive drum than at a position where the portion-to-be-positioned is when viewed in the direction of the rotation axis, the portion-to-be-regulated being configured to be engaged with the regulating portion so that movement of the cartridge relative to the apparatus main body in the direction of the rotation axis is regulated, the portion-to-be-regulated being aligned with the portion-to-be-positioned in a first direction orthogonal to the rotation axis when viewed in a direction orthogonal to the rotation axis and the first direction.

11. The cartridge according to claim 10, further comprising:

a frame;

a developing roller configured to carry toner to be supplied to the photosensitive drum;

a driving force reception member configured to receive driving force rotating the developing roller, from the apparatus main body;

a pressing member configured to be movable relative to the frame to move a driving force transmission member of the apparatus main body to an engagement position where the driving force transmission member engages with the driving force reception member; and an urging member configured to urge the pressing member in a direction in which the pressing member moves toward the engagement position.

12. The cartridge according to claim 11, wherein the frame includes a first end part and a second end part on a side opposite to the first end part in the direction of the rotation axis, wherein the pressing member is provided at the first end part of the frame, wherein the portion-to-be-positioned and the portion-to-be-regulated are provided at an end part of the cartridge on a side provided with the first end part in the direction of the rotation axis, and wherein the portion-to-be-regulated is configured to be engaged with the regulating portion to regulate movement of the cartridge at least in a direction from the first end part toward the second end part in the direction of the rotation axis.

13. The cartridge according to claim 10, wherein the portion-to-be-positioned is configured to be engaged with the positioning portion of the apparatus main body so that the cartridge is positioned relative to the apparatus main body in a first direction paralleled with the direction of the rotation axis and a second direction opposite to the first direction.

14. The cartridge according to claim 13, wherein the portion-to-be-regulated is configured to be engaged with the regulating portion so that movement of the cartridge relative to the apparatus main body in the first direction and the second direction is regulated.

15. The cartridge according to claim 10, the portion-to-be-positioned and the portion-to-be-regulated of the cartridge are grooves that are recessed in a direction orthogonal to the rotational axis.

* * * * *